US005621926A

United States Patent [19]

La Madeleine

[11] Patent Number: 5,621,926

[45] Date of Patent: Apr. 22, 1997

[54] SWIMMING POOL COVER SYSTEM

[76] Inventor: Gaétan La Madeleine, 13700 chemin St-Roch, Tracy, Québec, Canada, J3P 5N3

[21] Appl. No.: 507,675

[22] Filed: Jul. 25, 1995

[51] Int. Cl.[6] ..... E04H 4/10

[52] U.S. Cl. ..... 4/498; 4/503; 135/90; 135/120.4

[58] Field of Search ..... 4/494, 498, 500, 4/503; 135/90, 120.3, 120.4

[56] References Cited

U.S. PATENT DOCUMENTS

| | | | |
|---|---|---|---|
| 349,066 | 9/1886 | Stahl | 135/90 X |
| 645,890 | 3/1900 | Conrad | 135/90 X |
| 2,186,535 | 1/1940 | MacGeorge | 135/120.4 X |
| 2,796,072 | 6/1957 | Smith | 135/120.2 |
| 2,808,845 | 10/1957 | Wood | 135/122 |
| 3,021,530 | 2/1962 | Sears | 4/494 |
| 3,158,161 | 11/1964 | Knodel | 4/498 X |
| 3,683,427 | 8/1972 | Burkholz et al. | 4/503 X |
| 3,769,639 | 11/1973 | Bishop | 4/498 |
| 3,832,741 | 9/1974 | Ward | 4/500 |
| 3,895,400 | 7/1975 | Kelcey | 4/500 |
| 4,163,295 | 8/1979 | Schütz | 4/500 |
| 4,257,199 | 3/1981 | Kuboyama | 52/2.17 |
| 4,566,475 | 1/1986 | Wund | 135/99 |
| 4,651,496 | 3/1987 | Schildge, Jr. | 52/745.06 |
| 4,787,173 | 11/1988 | Lewis | 135/90 X |
| 4,951,327 | 8/1990 | Del Gorio, Sr. | 4/498 |
| 5,259,077 | 11/1993 | Hager et al. | 4/498 |

FOREIGN PATENT DOCUMENTS

| | | | |
|---|---|---|---|
| 3416889 | 11/1985 | Germany | 4/498 |
| 4136976 | 5/1993 | Germany | 4/498 |

*Primary Examiner*—Robert M. Fetsuga
*Attorney, Agent, or Firm*—Edwin E. Greigg; Ronald E. Greigg

[57] ABSTRACT

The swimming pool cover system is used for removably covering any type of swimming pool and for preventing objects or persons from falling into the pool. It comprises a flexible cover sheet having an outer edge removably connectable to locations along the swimming pool periphery. For covering the pool, the outer edge of the sheet is connected to the pool periphery and a central portion of the sheet is connected to a tautening cable mounted on a boom member extending over the pool. The sheet is then suspended and tautened above the water surface. The cover system comprises a sheet bundle cable mounted on the boom member for bundling up the sheet above the water surface when the cover system is in an uncovering position. The swimming pool cover system is very advantageous over other swimming pool covers because it is very simple and rapidly installed or removed. It may be very easily bundled up and stored away when not in use.

10 Claims, 5 Drawing Sheets

SWIMMING POOL COVER SYSTEM

FIELD OF THE INVENTION

The present invention relates to a swimming pool cover system and more particularly to a cover system preventing objects or persons from falling into the pool.

BACKGROUND OF THE INVENTION

Every year, we still hear about many accidental falls and drowning of young children into swimming pools. A practical solution developed in prior art for preventing these falls is to entirely cover the water surface of the pool with a covering structure or sheet of material. These cover systems are generally complex and tedious to install or to remove. As a result, they are often not used.

Among the various swimming pool covers, there is the one described in U.S. Pat. No. 3,832,741 (WARD). This swimming pool cover system comprises a sheet of material shaped for affixture about the periphery of the pool and supported above the swimming pool by an elongated boom member. The boom member is pivotally mounted on a retaining post adjacent to the pool. Although the swimming pool cover system described in WARD is simple and can be rapidly installed over the pool, it entails some disadvantages. For example, in the uncovering position, the cover sheet which is just lying suspended from its upper extremity to the raised boom member is believed to be very cumbersome and not aesthetic at all. Furthermore, on windy days, the wind just hits the cover sheet as it does for a flag or sail and the boom or the attachment means can easily break. For these reasons, this swimming pool cover ends up to be not very practical.

For the foregoing reasons, there are needs for a swimming pool cover system which is simple, easy to install or to remove rapidly and, most of all, easy to store when not in use over the swimming pool.

SUMMARY OF THE INVENTION

The object of the present invention is to provide a swimming pool cover system that satisfies the previously mentioned needs.

More particularly, the object of the present invention is to provide a swimming pool cover system for removably covering a water surface delimited by a swimming pool periphery and for preventing objects or persons from falling into the water when the cover system is in a covering position, the cover system comprising:

a flexible cover sheet having all outer edge;

connecting means for removably fixing the outer edge of the sheet to locations along the swimming pool periphery;

suspension means connectable to a central portion of the sheet for removably suspending the sheet above the water surface and for tautening the sheet in the covering position; and sheet bundle means mounted on the suspension means for bundling up the sheet above the water surface when the cover system is in an uncovering position;

whereby, in a covering position, the sheet is suspended above the water surface, fixed to locations along the swimming pool periphery and tautened thereto; and in an uncovering position, the connecting means are removed and the sheet is bundled up.

In a preferred embodiment of the present invention, the suspension means comprises a post adjacent to the swimming pool periphery and a boom member rotatably mounted on the post. The boom member has a free end provided with a first pulley. The suspension means also comprises a tautening cable slidable through the first pulley and having a first end removably connectable to the central portion of the sheet. It also comprises first blocking means mounted on the boom member for removably blocking the tautening cable.

In another preferred embodiment of the present invention, the cover sheet is provided with a central ring in its central portion and comprises a plurality of pieces of material joined together by a plurality of straps. Each strap has an inner end connected to the central ring and extending radially therefrom. In this preferred embodiment, the bundle means comprises at least three ropes extending radially from the central portion of the sheet and being equally distributed around the sheet. Each rope has a first end attached near the outer edge of the sheet to a corresponding strap and is slidably attached to at least one intermediary location along the same corresponding strap. Each rope also has a second end connected to a folding cable, the folding cable being slidable through a second pulley provided near the free end of the boom member. Also in this preferred embodiment, the bundle means further comprises second blocking means mounted on the boom member for selectively blocking the folding cable.

The water pool cover system according to the present invention is believed to be advantageous over prior art because it can be installed on any type of pool, it is light and simple, rapidly installable and removable. Furthermore, because the cover sheet may be very easily bundled up in a small pack and stored away when not in use renders the system very advantageous over prior art where the sheet remains suspended besides the pool and where it can be blown away on windy days.

A non restrictive description of a preferred embodiment will now be given with reference to the appended drawings.

DESCRIPTION OF A PREFERRED EMBODIMENT

Figure 1:
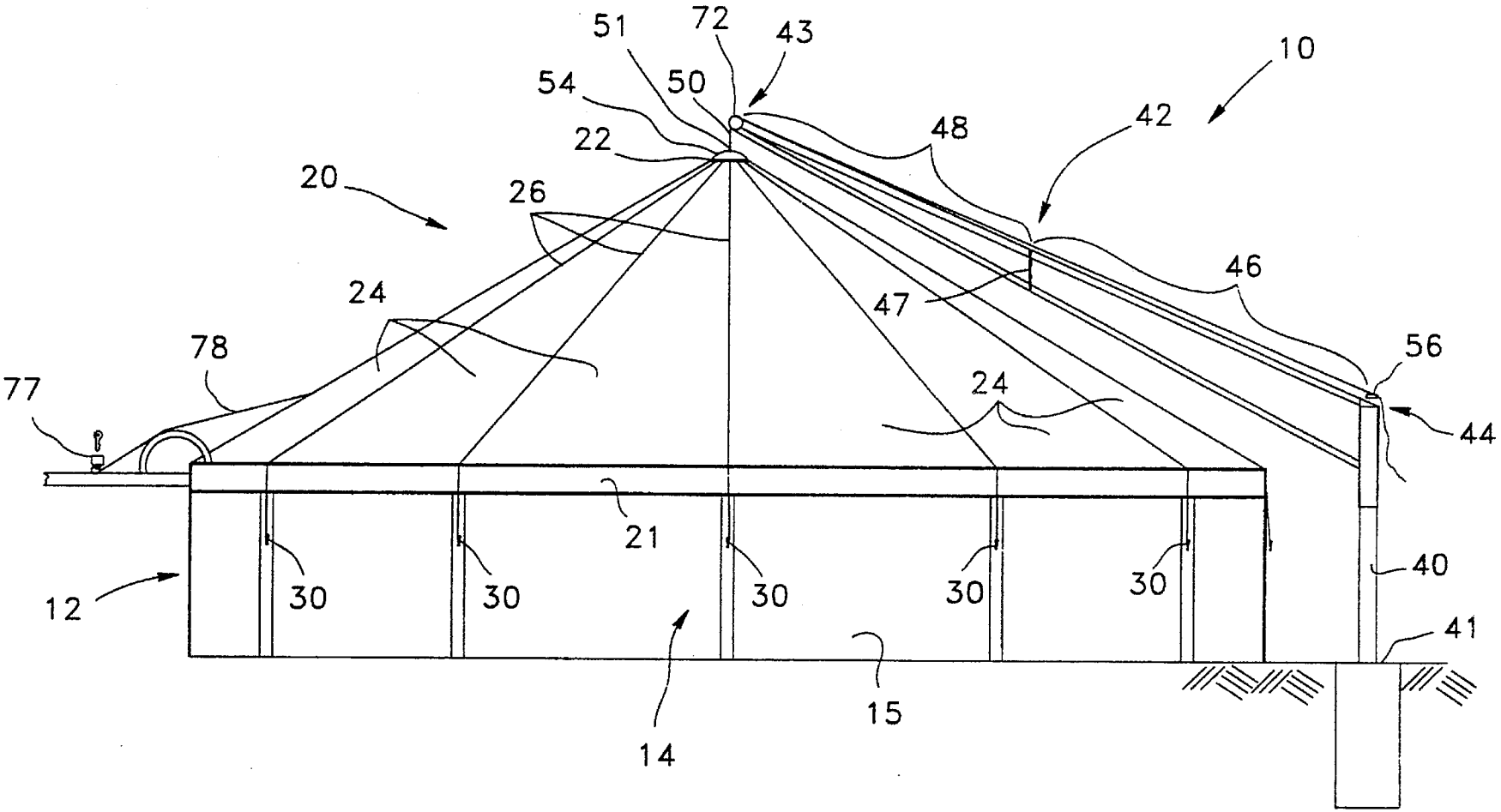
FIG. 1 is an elevational view of a swimming pool cover system according to a preferred embodiment of the present invention, shown in a covering position.
Figure 2:
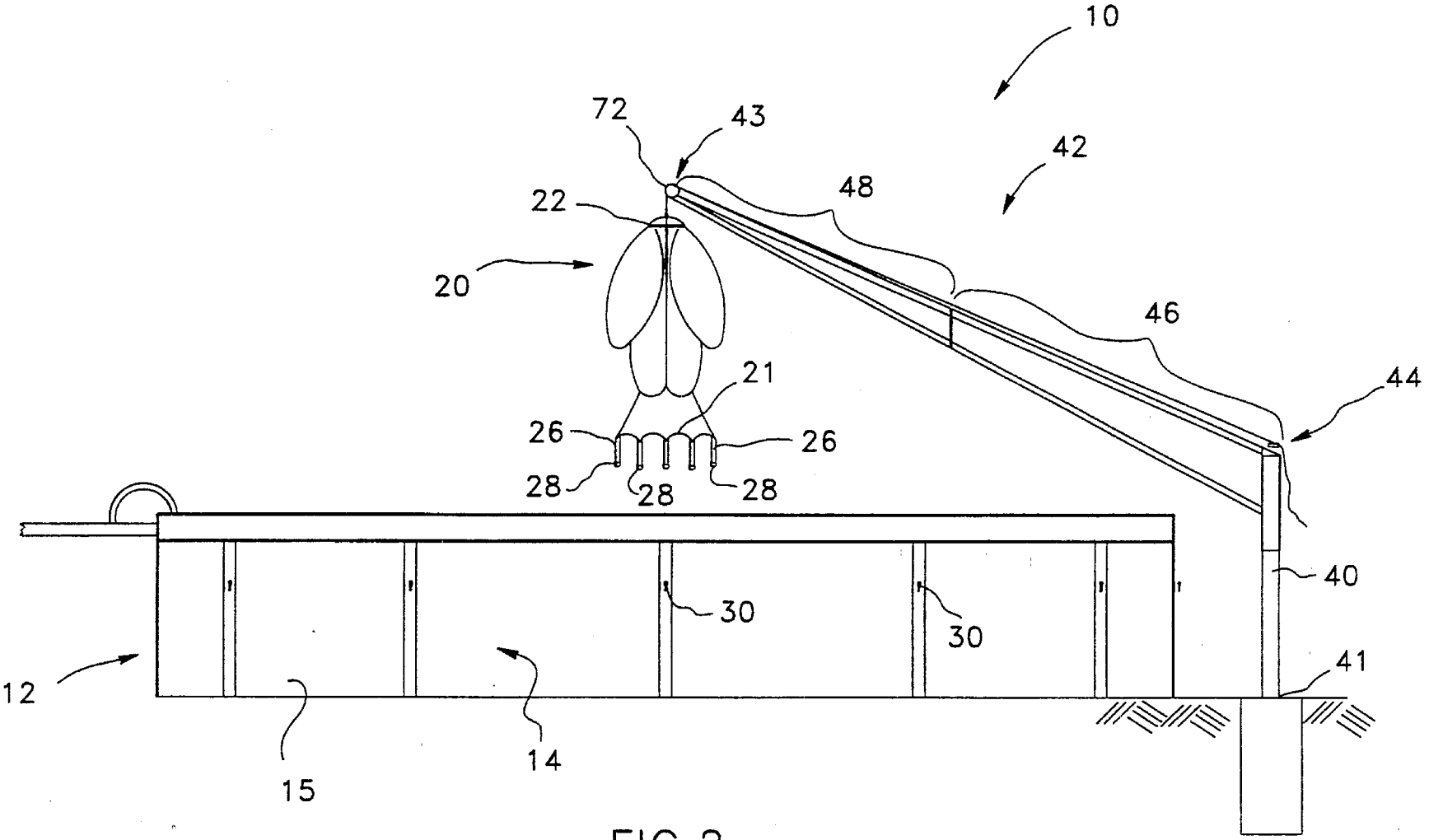
FIG. 2 is an elevational view of the swimming pool cover in FIG. 1, shown in an uncovering position.

Referring to FIGS. 1 and 2, a swimming pool cover system 10 according to a preferred embodiment of the present invention is shown for use with a circular above-ground pool 12. Advantageously, a cover system which embodies the features of the present invention may be used with any type or shape of below-ground and above-ground pools.

The swimming pool cover system 10 is used for removably covering a water surface delimited by the swimming pool periphery 14. It is also for preventing persons, mainly young children, or foreign matters such as leaves, dust, animals, from falling into the water when the cover system 10 is in a covering position, as in FIG. 1.

Figure 3:
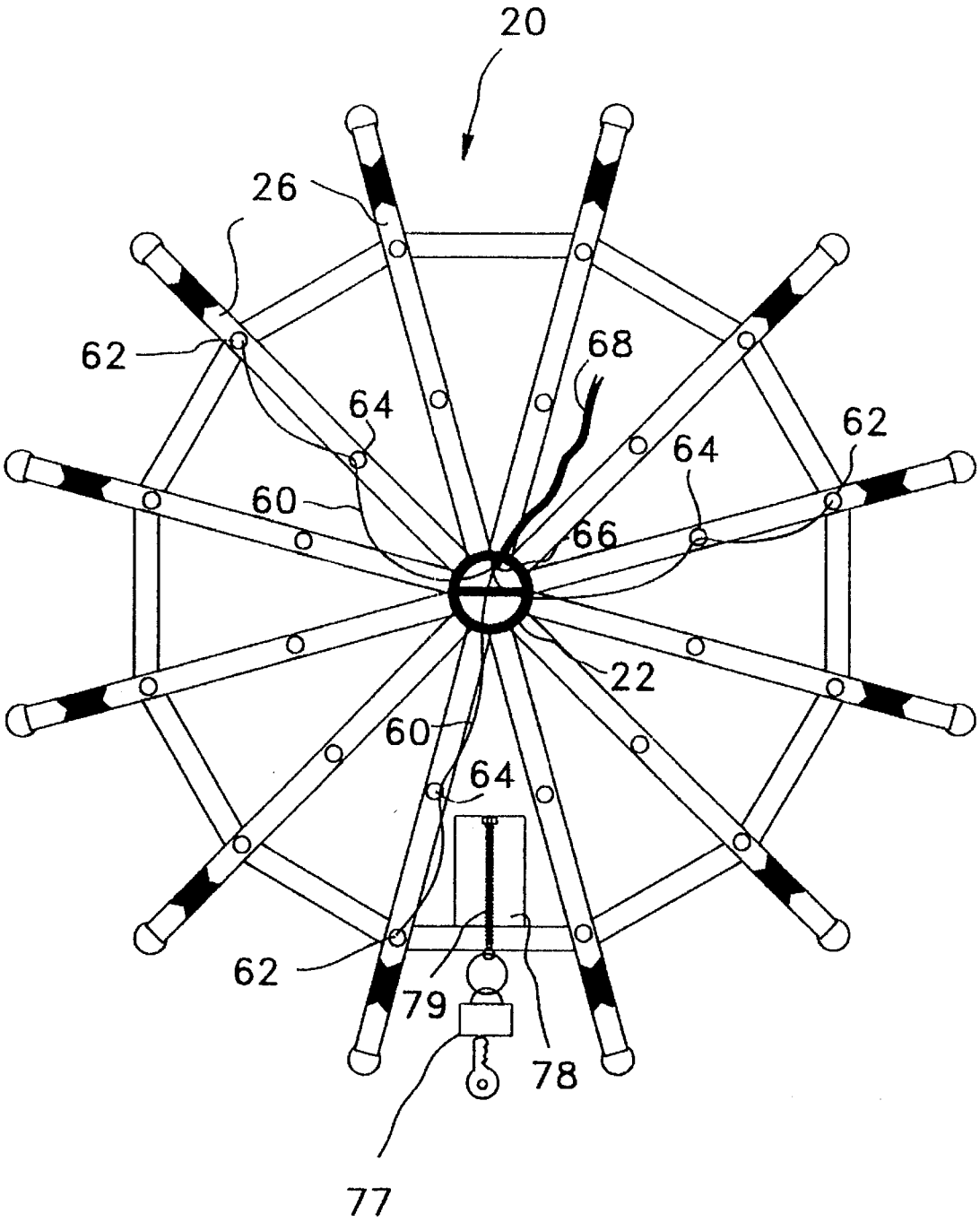
FIG. 3 is a top view of the cover sheet shown in FIG. 1 and showing it in an expanded position.

The cover system 10 comprises a flexible sheet 20. Preferably, as illustrated in FIGS. 1 to 3, the flexible sheet 20 is provided with a central ring 22 in its central portion and comprises a plurality of pieces of material 24 joined together with a plurality of straps 26. Each strap 26 is securely connected to the central ring and is extending radially therefrom. In this preferred embodiment which is intended to be used with a circular swimming pool, the sheet 20 comprises pieces of triangularly shaped material 24 sewn to straps 26. Preferably, the sheet 20 is made of a meshed or a net material which advantageously allows air and sun rays to pass through. Any type of strong meshed material known in the art such as nylon may be used. With this type of sheet, the swimmers can still swim in the pool, even if the cover system 10 is in a covering position. A solar sheet can even be installed for warming up the water during the day or for preventing the loss of heat during the night or on colder days. According to a preferred embodiment, the cover sheet is provided with a closable and lockable opening 78 for allowing access to the water surface when the cover system is in a covering position. Simply, as illustrated in FIG. 3, one piece of material 24 may be provided with a long zipper 79 sewn thereon and lockable by means of a padlock 77.

The cover system 10 also comprises a suspension means and a sheet bundle means. The suspension means is for removably suspending the sheet 20 above the water surface and for tautening it in the covering position. The sheet bundle means is mounted on the suspension means and is for bundling up the sheet above the water when the cover is in uncovering position.

Suspension means

Figure 4:
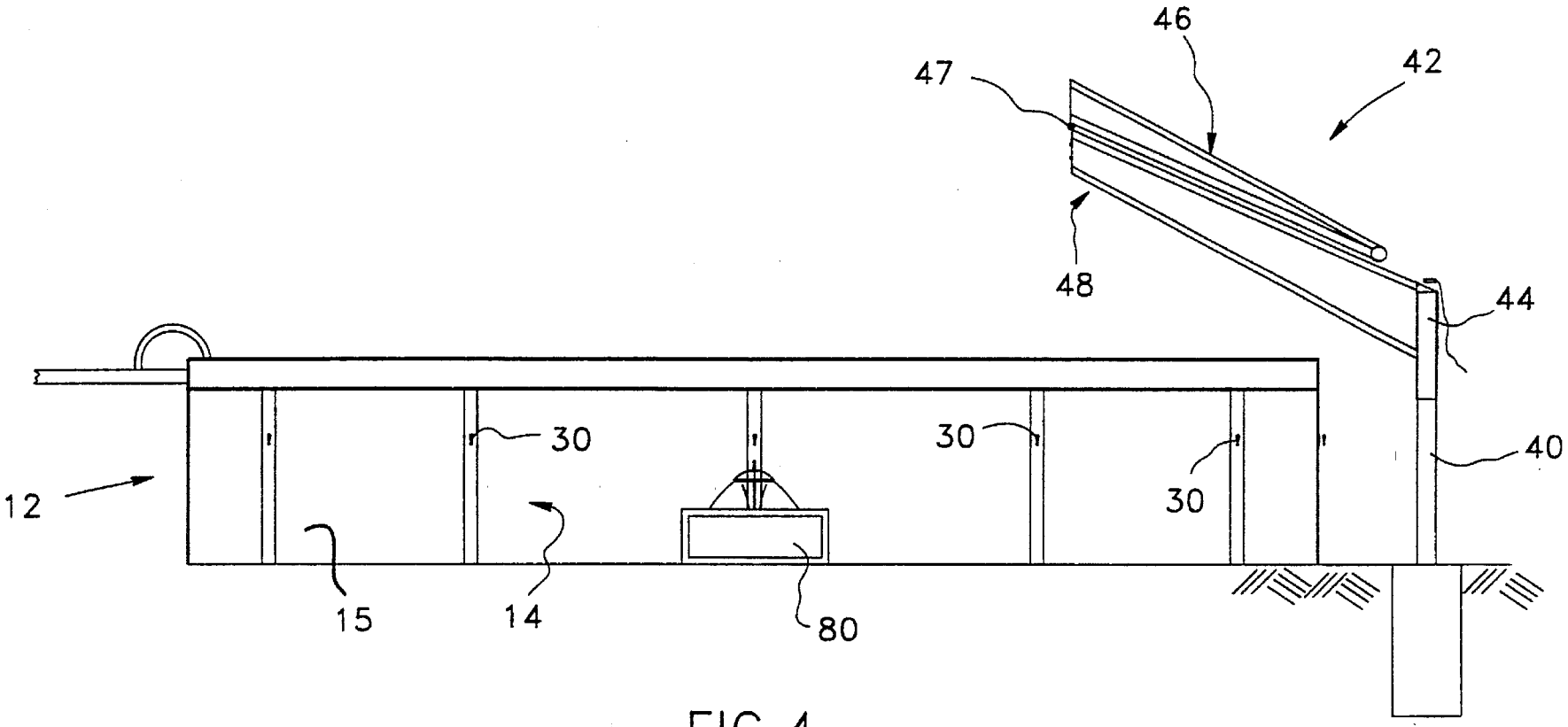
FIG. 4 is an elevational view of the swimming pool cover in FIG. 2, showing the boom member in a folded position and the sheet being stored in a storage box.

Preferably, as illustrated in FIGS. 1, 2 and 4, the suspension means comprises a post 40 adjacent to the swimming pool periphery 14 and secured to the ground by its base 41. The suspension means also comprises a boom member 42 having an end 44 rotatably mounted on the post 40. The boom member 42 can rotate left or right with reference to the base 41. In this preferred embodiment, the boom member 42 is defining an obtuse angle with the post 40 such that it substantially follows the shape of the tautened sheet 20 in the covering position. The boom member 42 comprises a distal portion 48 pivotally connected to a proximal portion 46 by means of a pivot or hinge 47. The distal portion 48 is movable in a vertical plane between an unfolded position and a folded position. In the unfolded position, the distal portion 48 is extending linearly with the proximal portion 46, as illustrated in FIGS. 1 and 2. In the folded position, it is folded on top of the proximal, portion 46, as illustrated in FIG. 4.

Figure 5:
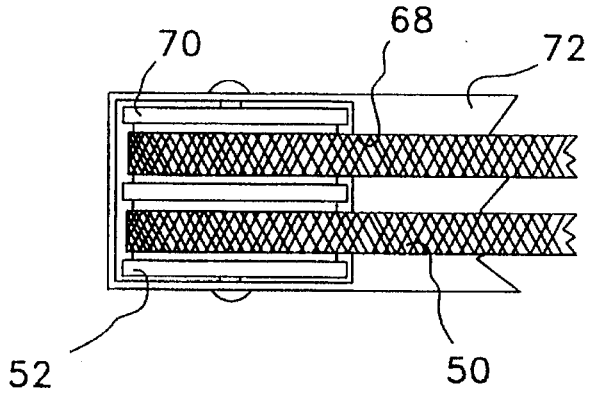
FIG. 5 is an enlarged top view of the tautening and folding cables mounted on the double pulley support.
Figure 6:
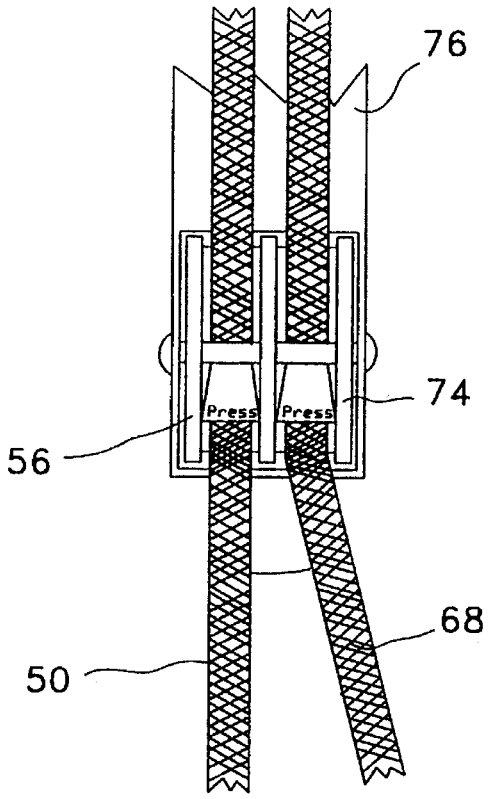
FIG. 6 is an enlarged top view of the lockable double pulley.

Referring to FIGS. 1, 5 and 6, the suspension means also comprises a tautening cable 50 slidable through a first pulley 52, preferably mounted at the free end 43 of the boom member 42. The tautening cable 50 has a first end 51 removably connectable to a length of rope 54 attached to the central ring 22. The tautening cable 50 may be connected by means of a shackle or a snap shackle (not illustrated), or any other kind of connecting means known in the art.

A first blocking means 56, which preferably consists of a lockable pulley 56, as illustrated in FIG. 6, is mounted on an end 44 of the boom member 42 which corresponds to the end connected to the post 40. This blocking means is for removably blocking the tautening cable 50. Obviously, in another preferred embodiment of the present invention (not illustrated), the lockable pulley 56 may be mounted somewhere else on the boom member 42 or directly on the post 40.

In use, for covering the swimming pool water surface, one just has to clip the tautening cable 50 to the length of rope 54 provided with the cover sheet 20 and rotate the boom member 42 above the water surface. Then, the outer edge 21 of the sheet 20 is fixed to locations along the swimming pool periphery 14. In the preferred embodiment illustrated, each strap 26 of the cover sheet 20 is provided at its outer edge 21 with an anchoring ring 28 and a plurality of hooks are equally distributed and fixed along the outer wall 15 of the swimming pool. Thus, for fixing the outer edge 21 of the cover sheet 20 to the swimming pool periphery 14, each of the anchoring rings 28 is respectively connected to one hook 30. In another embodiment (not illustrated), the outer edge of the sheet may also be connected to the swimming pool periphery 14 by means of an adhesive material such as VELCRO®. Any type of connecting means known by persons skilled in the art may be used without departing from the scope of the present invention. In another embodiment of the present invention (not illustrated) for covering a below-ground pool, the outer edge may be fixed directly to the rim or the edge of the swimming pool periphery.

Once the cover sheet 20 is fixed to the swimming pool periphery 14, it is tautened by pulling the tautening cable 50. Then, it remains tautened over the water surface by blocking the tautening cable 50 using the lockable pulley 56.

Sheet bundle means

Referring to FIGS. 3, 5 and 6, the sheet bundle means comprises ropes 60, three in the shown embodiment, extending radially from the central portion and being equally distributed around the sheet 20. In another preferred embodiment, the bundle means may comprise more than three of these ropes 60. Indeed, they may comprise as many ropes 60 as the cover sheet comprises straps. Each rope 60 has a first end 62 attached to a corresponding strap 26 near the outer edge 21 of the sheet 20. Each rope 60 is also slidably attached to at least one intermediary location 64 along the same corresponding strap 26 and it has a second end 66 connected to a folding cable 68. The folding cable 68 is slidable through a second pulley 70 provided on the boom member 42 and may be blocked by second blocking means. Preferably, the first pulley 52 and the second pulley 70 are adjacent to each other and are mounted in a double pulley support 72 located at the free end 43 of the boom member 42.

The second blocking means preferably comprises a second lockable pulley 74 adjacent to the first lockable pulley 56, and maintained in another double pulley support 76. Obviously, any other type of blocking means known in the art, such as a cleat or a clam cleat, may be used for blocking the tautening and the folding cable (50, 62).

In use, for uncovering the swimming pool water surface, the anchoring rings 28 are removed from the hooks 30 and the folding cable 62 is then pulled for bundling up the cover sheet 20 like in FIG. 2. The boom member 42 is then rotated for suspending the cover sheet 70 above the ground so that it can be easily removed from the boom member 42 and stored away. As illustrated in FIG. 4, a storage box 80 may be advantageously provided in the area of the pool for storing the cover sheet 20 when not in use.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A swimming pool cover system for removably covering a water surface delimited by a swimming pool periphery and for preventing objects or persons from falling into the water when the cover system is in a covering position, the cover system comprising:

a flexible cover sheet having an outer edge;

connecting means for removably fixing the outer edge of the sheet to locations along the swimming pool periphery; and suspension means connectable to a central portion of the sheet for removably suspending the sheet above the water surface and for tautening the sheet in the covering position; said suspension means comprising:

a post adjacent to the swimming pool periphery;

a boom member rotatably mounted on the post, the boom member having a free end provided with a first pulley located near the free end, the boom member comprising a distal portion pivotally connected to a proximal portion, the distal portion being movable in a vertical plane between an unfolded position where it is extending linearly with the proximal portion and a folded position where it is folded on top of the proximal portion;

a tautening cable slidable through the first pulley and having a first end removably connectable to the central portion of the sheet; and first blocking means mounted on the boom member for removably blocking the tautening cable: whereby, in a covering position, the sheet is suspended above the water surface, fixed to locations along the swimming pool periphery and tautened thereto.

2. A swimming pool cover system as claimed in claim 1, further comprising sheet bundle means mounted on the suspension means for bundling the sheet above the water surface when the cover system is in an uncovering position.

3. A swimming pool cover system as claimed in claim 2, wherein:

the sheet is provided with a central ring in its central portion and comprises a plurality of pieces of material joined together by a plurality of straps, each strap having an inner end securely connected to the central ring and extending radially therefrom; and the bundle means comprises at least three ropes extending radially from the central portion of the sheet and being equally distributed around the sheet, each rope having a first end attached near the outer edge of the sheet to a corresponding strap and being slidably attached to at least one intermediary location along the same corresponding strap, each rope having a second end connected to a folding cable, the folding cable being slidable through a second pulley provided near the free end of the boom member, and the bundle means further comprising second blocking means mounted on the boom member for selectively blocking the folding cable.

4. A swimming pool cover system as claimed in claim 3, wherein the sheet is made of a meshed material.

5. A swimming pool cover system as claimed in claim 4, wherein the first pulley and the second pulley are adjacent and are mounted in a double pulley support.

6. A swimming pool cover system as claimed in claim 5, wherein the connecting means comprises a plurality of hooks fixed along the swimming pool periphery and a plurality of anchoring rings provided on another end of each strap, each of the anchoring rings being respectively connectable to one hook.

7. A swimming pool cover system as claimed in claim 1, wherein the flexible sheet is provided with a closable and lockable opening for allowing access to the water surface when the cover system is in a covering position.

8. A swimming pool cover system for removably covering a water surface delimited by a swimming pool periphery and for preventing objects or persons from falling into the water when the cover system is in a covering position, the cover system comprising:

a flexible cover sheet having an outer edge and being made of a meshed material, the sheet being provided with a central ring in its central portion and comprising a plurality of pieces of material joined together by a plurality of straps, each strap having an inner end securely connected to the central ring and extending radially therefrom;

connecting means for removably fixing the outer edge of the sheet to locations along the swimming pool periphery;

suspension means connectable to a central portion of the sheet for removably suspending the sheet above the water surface and for tautening the sheet in the covering position, said suspension means comprising:

a post adjacent to the swimming pool periphery;

a boom member rotatably mounted on the post, the boom member having a free end provided with a first pulley located near the free end, and comprising a distal portion pivotally connected to a proximal portion, the distal portion being movable in a vertical plane between an unfolded position where it is extending linearly with the proximal portion and a folded position where it is folded on top of the proximal portion;

a tautening cable slidable through the first pulley and having a first end removably connectable to the central portion of the sheet; and first blocking means mounted on the boom member for removably blocking the tautening cable; and sheet bundle means mounted on the suspension means for bundling up the sheet above the water surface when the cover system is in an uncovering position, the bundle means comprising at least three ropes extending radially from the central portion of the sheet and being equally distributed around the sheet, each rope having a first end attached near the outer edge of the sheet to a corresponding strap and being slidably attached to at least one intermediary location along the same corresponding strap, each rope having a second end connected to a folding cable, the folding cable being slidable through a second pulley provided near the free end of the boom member, and the bundle means further comprising second blocking means mounted on the boom member for selectively blocking the folding cable, the first pulley and the second pulley being adjacent and mounted in a double pulley support;

whereby, in a covering position, the sheet is suspended above the water surface, fixed to locations along the swimming pool periphery and tautened thereto, and in an uncovering position, the connecting means are removed and the sheet is bundled up.

9. A swimming pool cover system as claimed in claim 8, wherein the connecting means comprises a plurality of hooks fixed along the swimming pool periphery and a plurality of anchoring rings provided on another end of each strap, each of the anchoring rings being respectively connectable to one hook.

10. A swimming pool cover system as claimed in claim 9, wherein the flexible sheet is provided with a closable and lockable opening for allowing access to the water surface when the cover system is in a covering position.

* * * * *